US005868380A

United States Patent [19]

Allen

[11] Patent Number: 5,868,380

[45] Date of Patent: Feb. 9, 1999

[54] PULLEY BLOCK WITH SPRING-BIASED SELECTIVELY OPERABLE RATCHET

[75] Inventor: Tony Carlton Allen, Essex, United Kingdom

[73] Assignee: Allen Brothers (Fittings) Ltd., Essex, United Kingdom

[21] Appl. No.: 567,330

[22] Filed: Dec. 5, 1995

[51] Int. Cl.[6] ..... B66D 3/04

[52] U.S. Cl. ..... 254/391; 254/266

[58] Field of Search ..... 254/391, 390, 254/266

[56] References Cited

U.S. PATENT DOCUMENTS

| | | | |
|---|---|---|---|
| 210,281 | 11/1878 | Weston | 254/391 X |
| 5,319,997 | 6/1994 | Galloway et al. | 74/577 |
| 5,511,447 | 4/1996 | Galloway et al. | 74/577 |

FOREIGN PATENT DOCUMENTS

| | | | |
|---|---|---|---|
| 35045 | 10/1929 | France | 254/391 |
| 11744 | of 1884 | United Kingdom | 254/391 |
| 27285 | of 1898 | United Kingdom | 254/391 |
| 288418 | 4/1928 | United Kingdom | 254/391 |

*Primary Examiner*—Donald P. Walsh
*Assistant Examiner*—Emmanuel M. Marcelo
*Attorney, Agent, or Firm*—McDermott, Will & Emery

[57] ABSTRACT

A pulley block or sheave includes a pulley (3), a mounting frame (2) for the pulley and in which the pulley is rotatable, and a ratchet wheel (11) rotatable with the pulley and including ratchet teeth (12). A pawl (15) is carried by the mounting frame and is movable to engage the teeth to prevent or inhibit rotation of the ratchet wheel and the pulley in one sense and disengageable from the teeth to allow free rotation of the pulley. A spring mechanism (13) is included for urging the pawl into engagement with the teeth, the spring mechanism being movable relative to the frame between a position in which the pawl is held away from the teeth by the spring mechanism and a position in which the pawl is urged into engagement with the teeth by the spring mechanism, and an actuating member co-operating with the spring mechanism is provided to move the spring mechanism between said positions.

6 Claims, 2 Drawing Sheets

PULLEY BLOCK WITH SPRING-BIASED SELECTIVELY OPERABLE RATCHET

FIELD OF THE INVENTION

The present invention relates to a block i.e. a pulley block or sheave, incorporating a ratchet which can be selectively rendered operative or inoperative.

BACKGROUND OF THE RELATED ART

A sheet is a rope or line for controlling the set of a sail on a sailing vessel. Conventionally the sheet is passed through one or more pulley blocks or sheaves attached to the sail (or boom) and the hull of the vessel. In light weather it is desirable that the sheet runs freely through the pulley block. However, when hauling in the sail in heavy weather it is desirable that the pulley block may incorporate a ratchet to prevent or inhibit the sheet running out through the pulley block e.g. when the helmsman (or crew) adjusts his hands on the sheet.

It is known to provide a pulley block with a ratchet which can be manually selectively rendered operative and inoperative.

It is also known to provide a pulley block with a ratchet which is inoperative when light loads are applied to the block. This known pulley block comprises a ratchet wheel with outwardly directed teeth and a pawl for engaging the teeth. When intermediate loads are applied to the block the pawl may engage only partially with the teeth. Consequently ratchet action may not be positive, the ratchet repeatedly becoming operative and then inoperative, and the teeth and the pawl are subject to heavy wear.

The present invention aims to provide an improved pulley block or sheave incorporating a ratchet mechanism.

SUMMARY OF THE INVENTION

In accordance with the present invention there is produced a pulley block or sheave, comprising;

a pulley;

a mounting frame for the pulley and in which the pulley is rotatable;

a ratchet wheel rotatable with the pulley and including ratchet teeth;

a pawl carried by the mounting frame and movable to engage the teeth to prevent or inhibit rotation of the ratchet wheel and the pulley in one sense and disengageable from the teeth to allow free rotation of the pulley;

spring means for urging the pawl into engagement with the teeth, the spring means being movable relative to the frame between a position in which the pawl is held away from the teeth by the spring means and a position in which the pawl is urged into engagement with the teeth by the spring means;

and an actuating member co-operating with the spring means to move the spring means between said positions.

The actuating member may be operated manually or otherwise by a person, such as the helmsman or a crew member of a sailing vessel, or may be operated in response to the load applied to the pulley block or sheave.

In the latter case the pulley block or sheave may comprise an attachment member for use in attaching the block or sheave to another member, e.g. the boom of a sailing vessel and connected to the actuating member, the mounting frame being translationally moveable relative to said attachment member, and resilient means acting between the attachment member and the mounting frame such that under a light load applied to the pulley block the actuating member does not move the spring means sufficiently to cause the pawl to engage the ratchet teeth but under a heavy load the mounting frame is moved against the force of the resilient means and relative to said attachment member to cause the actuating member to be moved relative to the mounting frame thereby to cause the actuating member to move the spring means to cause the pawl to engage the ratchet teeth.

Preferably the teeth of the ratchet wheel are internally directed, the pawl being within the ratchet wheel.

The resilient means may be a compression or coil spring.

The spring means may be a hairpin spring.

Alternatively the spring means may be a torsion spring and may be carried by the actuating member to act between the actuating member and the pawl.

The torsion spring may be of a positive switching type so that as the load is progressively increased the spring remains in a first position where the pawl is not engaged with the teeth of the ratchet wheel until when the load has reached a first predetermined level the spring switches to a second position where the pawl is engaged with the teeth of the ratchet wheel, and when the load is decreased the spring remains in the second position until the load reaches a second predetermined level, at which the spring switches back to the first position in which the pawl is disengaged from the teeth of the ratchet wheel. This arrangement provides a positive action, thereby obviating excessive wear of the ratchet teeth and the pawl caused by partial engagement of the pawl with the teeth.

Preferably the first predetermined level of the load is such that the resilient means is close to its full compression. Also preferably the second predetermined level of the load is such that the resilient means is close to being fully relieved.

BRIEF DESCRIPTION OF THE DRAWING

The invention is further described below by way of example with reference to the accompanying drawings, wherein.

DETAILED DESCRIPTION OF THE PREFERRED EMBODIMENTS

The terms "upper", "lower", "vertical", "clockwise" and "anticlockwise" and like terms used below refer to the pulley blocks when in a vertical orientation as viewed in FIGS. 1, 3 and 4. In actual use of the pulley blocks they will usually be orientated more nearly horizontal than vertical.

Figure 1:
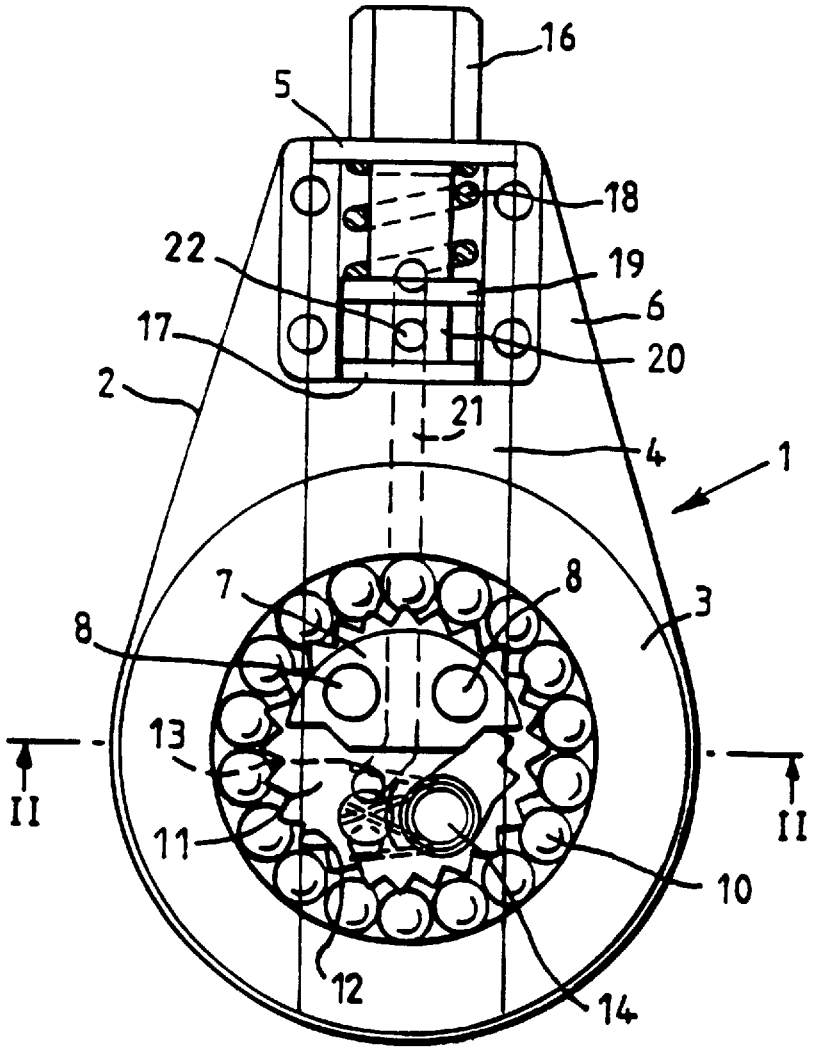
FIG. 1 is a sectional view of a pulley block according to the invention.
Figure 2:
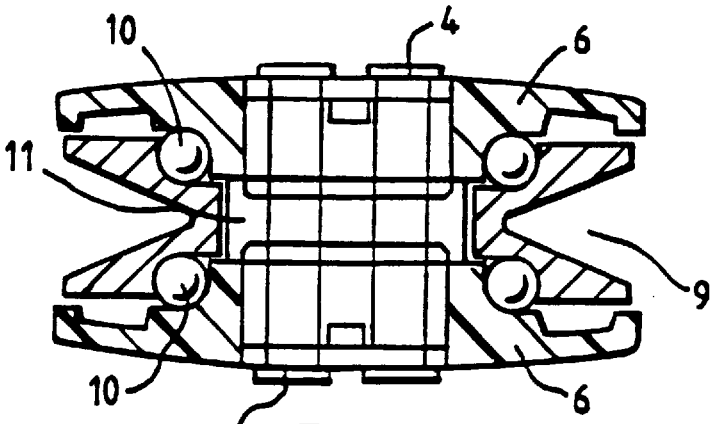
FIG. 2 is another sectional view of the pulley block, along line II—II of FIG. 1.
Figure 3:
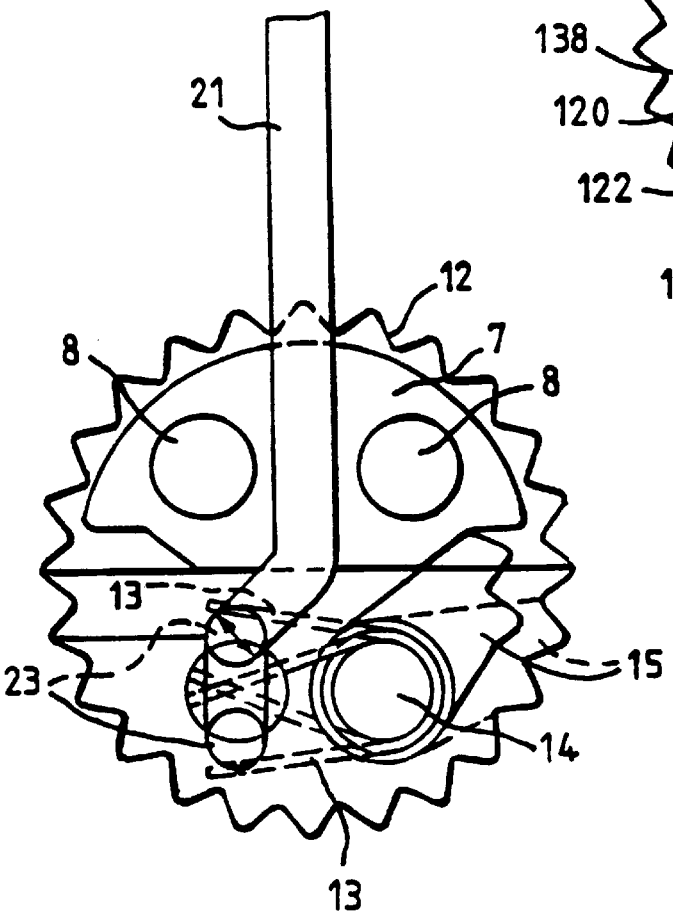
FIG. 3 is an enlarged view of a detail of FIG. 1.

Referring to FIGS. 1 to 3 of the drawings, a pulley block or sheave 1 comprises a mounting frame 2 in which a pulley 3 is rotatably mounted.

The mounting frame 2 comprises a metal yoke having two side arms 4 connected by an upper transverse portion or web 5 and two plastic side plates 6.

Each side plate 6 is provided with a protuberance or abutment 7, the two protuberances abutting each other along a vertical centre plane of the pulley block 1 to hold the plates apart. Rivets pass through holes in the side arms 4 and holes 8 in the plates and protuberances 7 to hold the pulley block assembled.

The pulley 3 has a V-groove 9 and runs on a pair of ball races 10 between the pulley and the side plates 6.

A ratchet wheel 11 is attached to the pulley 3 for rotation therewith and is disposed between the ball races 10. The ratchet wheel 11 has internally directed ratchet teeth 12.

A hairpin spring 13 is pivotally mounted on a shaft 14 fixed between the side plates 6. A pawl 15 is also pivotally mounted on the shaft 14. The spring 13 and the pawl 15 are fastened together so that they pivot together.

The spring 13 and the pawl 15 can pivot between the position shown in solid lines and the position shown in broken lines in FIG. 3.

The pulley block 1 further comprises an attachment or connecting rod 16 for use in attaching the block to e.g. the boom of a sailing vessel. The rod 16 may be rotatable about its own axis. A disc 17 is fast on the lower end of the rod 16.

The frame 2 is slidable relative to the rod 16. A coil spring 18 acts between the frame 2 and the rod 16. The coil spring 18 bears on the transverse portion 5 of the yoke of the frame 2 and a washer 19 mounted on the rod 16. The rod 16 passes through a hole in the transverse portion 5. A bush 20 is mounted on the rod 16 between the disc 17 and the washer 19.

An actuating rod 21 (see FIG. 3) is slidably located between one of the arms 4 and the adjacent side plate 6 in a guide channel in the plate. The rod 21 is provided with a laterally projecting pin at its upper end, the pin engaging in a radial bore 22 in the bush 20. Accordingly when the attachment rod 16 moves upwardly or downwardly relative to the frame 2, the actuating rod 21 is similarly moved upwardly or downwardly relative to the frame. The rod 21 extends through the frame 2 to a cranked end portion which is formed with a lateral projection 23 which extends between arms of the spring 13.

In use of the pulley block 1 the connecting rod 16 is attached to the boom of a sailing vessel, usually through a shackle. A sheet is passed through the pulley block 1 around the pulley 3. The sheet is gripped in the V-groove 9 of the pulley 3 so that the sheet, at least when under load, does not slip relative to the pulley.

Under light loads applied to the sheet the spring 18 is under only a low compressive force and the attachment rod 16 and the actuating rod 21 are in a lower position wherein the projection 23 engages the torsion spring 13 to hold the pawl 15 out of engagement with the ratchet teeth 12 so that the pulley 3 can rotate freely in either sense (i.e. clockwise or anticlockwise).

As the load applied to the sheet is increased, the frame 2 is pulled downwards against the force of the compression spring 18, which is thereby compressed.

Accordingly under a heavy load applied to the sheet the attachment rod 16 and the actuating rod 21 are thus moved relative to the frame 2 and the projection 23 of the actuating rod pivots the spring 13 to the position shown in broken lines in FIG. 3. The pawl 15 pivots with the spring 13 and is urged by the spring into engagement with the ratchet teeth 12 to prevent or inhibit rotation of the ratchet wheel 11 and the pulley 3 in the clockwise sense.

When the load applied to the block 1 decreases the spring 18 moves the block upwardly relative to the pulley rod 16 thereby allowing the pawl 15 to disengage from the ratchet teeth 12 to again allow the pulley 14 to rotate freely in either sense.

Figure 4:
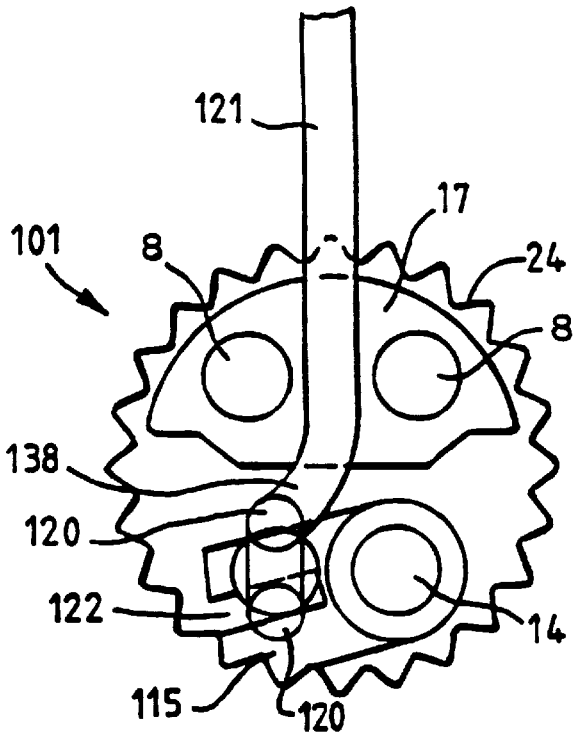
FIG. 4 is similar to FIG. 3 but relates to another pulley block according to the invention.
Figure 5:
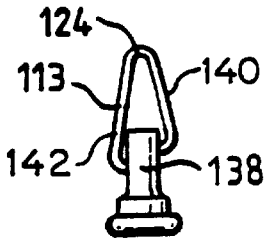
FIG. 5 is a plan view of a torsion spring and an end portion of an actuating rod of FIG. 4.
Figure 6:
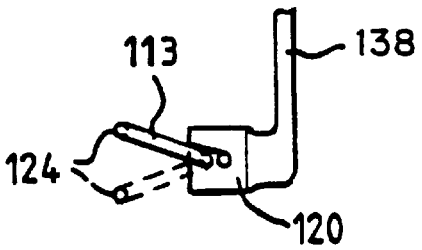
FIG. 6 is a side view of the torsion spring and the end portion of FIG. 4.

Referring to FIGS. 4 to 6 of the drawings, a pulley block 101 is generally similar to the pulley block 1 of FIGS. 1 to 3 except as described below. Corresponding parts in FIGS. 1 to 4 have the same reference numerals as in FIGS. 1 to 3 or the same reference numerals with the addition of 100.

The pulley block 101 has, instead of the hairpin spring 13, a torsion spring 113 of a positive switching type. The spring 113 is in the form of a loop having two arms, 140 and 142, of different lengths with inturned free ends engaged in respective, mutually offset holes in a lateral projection 120 of the cranked end portion 138 of the connecting rod 121. Because the arms of the spring 113 are of different offset the spring is biased to either one of two stable positions, as shown in full lines and broken lines respectively in FIG. 6. The spring 113 can be moved between the two stable positions through an unstable "top dead centre" position, i.e. the spring is an overcentre spring. The two stable positions of the spring 113 are an upper position shown in full lines in FIG. 6 and a lower position shown in broken lines in FIG. 6.

The spring 113 extends from the projection 120 into a slot 122 in the pawl 115, a bight portion 124 of the spring intermediate its ends engaging with the pawl.

The pulley block 101 is used in like manner to the pulley block 1.

When the load applied to the sheet is zero the torsion spring 113 is in its upper position and the pawl 115 is held out of engagement with the ratchet teeth 12. As the applied load is increased the rod 121 moves upwardly relative to the frame 2 but the spring 113 remains in its upper position with the pawl held out of engagement with the ratchet teeth 24, until the load reaches a first predetermined level. When the load reaches the first predetermined level, at which the spring 18 is close to its full compression, the torsion spring 113 is being pushed downwardly sufficiently hard against the pawl 115, which is prevented from pivoting clockwise by engagement with the abutments 17 that the torsion spring flips through its top centre position to its lower position. The spring 113 when in its lower position urges the pawl into engagement with the ratchet teeth 12.

When the pawl 115 is engaged with the ratchet teeth 12 the pawl prevents or inhibits rotation of the ratchet wheel 11 and the pulley 3 in the anticlockwise sense.

When the load is thereafter decreased, the rod 121 moves downwardly relative to the frame 2 but the pawl 115 remains in positive engagement with the ratchet teeth 12 until the load reaches a second predetermined level, which is less than the first predetermined level, at which the coil spring 18 (not shown in FIGS. 4 to 6) is close to being fully relieved (i.e. under no compression).

As the load decreases below the second predetermined level the torsion spring 113 is being pushed upwardly sufficiently hard against the pawl 115, which is prevented from pivoting anticlockwise by engagement with the ratchet teeth 12 that the torsion spring flips back through its top centre position to its first position, in which it holds the pawl out of engagement with the ratchet teeth 12.

Thus there is no load at which the pawl 115 is not fully engaged with the ratchet teeth or held out of engagement with the ratchet teeth. Thus the action of the pawl 115 is positive and excessive wear of the pawl and the ratchet teeth 12 caused by partial engagement of the pawl with the ratchet teeth 24 obviated.

It will be appreciated that a relatively small movement of the connecting rod 121 between its positions when the spring 18 is fully relieved and fully compressed causes the spring 113 to flip from one of its stable positions to the other and thereby causes a relatively large movement of the bight portion 124 of the spring 113 in the opposite direction to that in which the rod 121 has moved. Thus flipping of the spring 113 between its two positions or states causes the toothed free end portion of the pawl 115, which end portion engages with the ratchet teeth 12, to move in the opposite direction to the rod 121 and by a much larger amount than the rod.

Although the present invention has been described and illustrated in detail, it should be clearly understood that the same is by way of illustration and example only and is not to be taken by way of limitation, the spirit and scope of the present invention being limited only by the terms of the appended claims.

I claim:

1. A pulley block or sheave, comprising:

a pulley;

a mounting frame for the pulley and in which the pulley is rotatable;

a ratchet wheel rotatable with the pulley and including ratchet teeth;

a pawl mounted on the mounting frame and movable to engage the teeth to prevent or inhibit rotation of the ratchet wheel and the pulley in one sense and disengageable from the teeth to allow free rotation of the pulley;

an actuating member translationally movable relative to the mounting frame;

an attachment member for use in attaching the block or sheave to another member and connected to the actuating member for movement therewith relative to the mounting frame;

resilient means acting between the attachment member and the mounting frame for providing a force therebetween when a load is applied to the pulley and the attachment member; and off center spring means carried by the actuating member and cooperating with the pawl for urging the pawl into and out of engagement with the teeth, the spring means being movable by the actuating member relative to the frame between a first position in which the pawl is held away from the teeth by the spring means and a second position in which the pawl is urged into engagement with the teeth by the spring means, such that under a light load applied to the pulley block or sheave the pawl is held by the spring means in a first position away from the teeth of the ratchet wheel and when the load progressively increases the mounting frame is moved against the force of the resilient means and relative to the attachment member to cause the actuating member to be moved relative to the mounting frame but the spring means remains in its first position, where the pawl is not engaged with the teeth, until the load has reached a first predetermined level at which the spring means switches to the second position, where the pawl is engaged with the teeth of the ratchet wheel, and when the load thereafter decreases, the mounting frame is moved by the force of the resilient means relative to the attachment member to cause the actuating member to be moved relative to the mounting frame but the spring means remains in its second position until the load reaches a second predetermined level at which the spring means returns to its first position, where the pawl is not engaged with the teeth of the ratchet wheel, the second predetermined level being less than the first predetermined level.

2. The pulley block or sheave according to claim 1, wherein: the teeth of the ratchet wheel are internally directed, the pawl being within the ratchet wheel.

3. The pulley block or sheave according to claim 1, wherein: the resilient means is a compression or coil spring.

4. The pulley block or sheave according to claim 1, wherein: the first predetermined level of the load is such that the resilient means is close to its full compression.

5. The pulley block or sheave according to claim 1, wherein:

the second predetermined level of the load is such that the resilient means is close to being fully relieved of compression.

6. The pulley block or sheave according to claim 1, wherein:

the spring means is a torsion spring in the form of a loop having two arms of different lengths, free ends of which are engaged in a portion of the actuating member, the spring also having a bight portion intermediate the ends of the spring and engageable in a slot in the pawl to effect movement of the pawl between the first and second positions.

* * * * *